United States Patent [19]

Carter

[11] 4,104,711

[45] Aug. 1, 1978

[54] AIRPORT LIGHT FIXTURE

[75] Inventor: Herbert F. Carter, Simsbury, Conn.

[73] Assignee: Connecticut International Corporation, Windsor Locks, Conn.

[21] Appl. No.: 800,183

[22] Filed: May 25, 1977

[51] Int. Cl.[2] ..... F21S 1/02

[52] U.S. Cl. ..... 362/153; 362/363; 362/390; 362/431

[58] Field of Search ..... 240/1.2; 362/153, 363, 362/390, 431

[56] References Cited

U.S. PATENT DOCUMENTS 3,501,627 3/1970 Macemon ..... 240/1.2

*Primary Examiner*—Stephen J. Lechert, Jr.

*Attorney, Agent, or Firm*—Prutzman, Hayes, Kalb & Chilton

[57] ABSTRACT

An airport light fixture is designed to withstand the severe vibrations and high wind velocity encountered in the take-off and landing operations of jet aircraft. The light fixture includes a pedestal and lamp base provided with spherical portions of different curvature which engage only at peripheral mating surfaces. When the lamp base and pedestal are clamped together, e.g., by a set of bolts, considerable pressure is exerted between the spherical portions to hold the pedestal and lamp base in firm engagement at the peripheral mating surfaces. In addition, the light fixture includes an improved lens mounting arrangement to firmly secure its lens on the lamp base and yet permit the lens to be conveniently removed for repair of the light fixture.

5 Claims, 3 Drawing Figures

AIRPORT LIGHT FIXTURE

The present invention relates to an airport light fixture and, more particularly, to an improved light fixture especially suitable for use as a runway or taxiway edge light at an airport.

To provide markers for airport runways and taxiways, it has become customary to employ light fixtures along the edges of runways and taxiways to facilitate guidance of aircraft during take-off and landing operations. Conventional runway and taxiway edge light fixtures typically consist of an upright support member or pedestal with a lamp assembly and lens mounted at its upper end. The support member is threadably or otherwise engageable at its lower end with a base plate permanently mounted in the runway or taxiway. The lens provides a protective cover for the lamp assembly and can be optically configured to transmit light only in a predetermined direction.

Such airport light fixtures are subjected to severe vibrations and high wind velocity especially during take-offs and landings of jet aircraft. To preserve the desired directional alignment of these light fixtures, it is imperative that such fixtures be able to withstand the vibrations and wind velocity without becoming tilted, misaligned or otherwise out of adjustment. However, it is also necessary to provide an airport light fixture with a firmly secured but conveniently removable lens to facilitate repair or replacement of the lamp assembly or lens.

In the prior art, airport light fixtures have been proposed wherein the upright support and lamp base have spherical surfaces with the same radius of curvature which are clamped together by a set of bolts. However, such conventional fixtures tend to work loose and become tilted or misaligned when subjected to the strong vibrations and high wind velocity caused by jet aircraft. As a result, frequent inspection and readjustment of these light fixtures is required. Further, the lens mounting arrangements of such conventional fixtures are cumbersome and difficult to disengage when necessary to repair or replace the lamps or lenses.

A primary objective of the present invention is to provide an airport light fixture which can withstand the severe vibrations and high wind velocity encountered at modern airports. Another objective is to provide an improved runway or taxiway light assembly which avoids the tendency of previous light fixtures to become loosened and misaligned after installation. Another purpose of the invention is to provide an improved mounting arrangement in which the lamp base is held in firm engagement with its vertical support member. A further purpose is to provide an airport light fixture having a conveniently removable lens to facilitate repair or replacement of its lamp or lens.

The present invention achieves the above objectives in an airport light fixture comprising a support member, a lamp base mounted on the support member, the support member and base having spherical portions of different curvature which engage at peripheral mating surfaces thereon, a lamp mounted on the lamp base, a lens cooperating with the base to cover the lamp, and means cooperating with the lamp base and the support member for clamping the peripheral mating surfaces together. By virtue of the difference in curvature, the lamp base and support member engage only at the peripheral mating surfaces. Considerable pressure is concentrated at the peripheral mating surfaces to firmly hold the lamp base and support member together. Thus, the light fixture is able to withstand the severe vibrations and high wind velocity encountered in aircraft take-offs and landings, and resist the tendency to become tilted or misaligned.

A preferred embodiment of the airport light fixture comprises a support member having an upwardly opening, concave recess, a lamp base having a convex bottom portion received within the concave recess of the support member, the convex portion of the lamp base having a different curvature than the concave recess of the support member and engaging the support member at the periphery of the concave recess, a lamp mounted on the lamp base, a lens cooperating with the lamp base to cover the lamp, and means for clamping the lamp base and support member together at the periphery of the recess. Preferably, the convex portion of the lamp base has a larger radius of curvature than the concave recess to permit the lamp base to engage the support member only at the periphery of the recess. The clamping means may comprise a plurality of bolts spaced uniformly about the lamp base and extending through its convex bottom portion into the support member to hold the base and support member in firm engagement at the periphery of the recess.

In the preferred embodiment, the lamp base has a generally circular top portion with a plurality of upstanding flanges spaced about the periphery thereof and adapted to provide radially inward facing channels. The lens is dome-shaped and includes a plurality of outwardly projecting tongues at its base received within the channels to fasten the lens to the lamp base. Preferably, stop means is provided on the lamp base for limiting movement of the tongues into the channels. In addition, at least one of the flanges includes locking means for confining the corresponding tongue within its channel to prevent disengagement of the lens from the lamp base. The lens mounting arrangement of the preferred embodiment permits convenient removal of the lens when necessary for access to the lamp.

The accompanying drawings illustrate a preferred embodiment of the present invention and, together with the description, serve to explain the principles of the invention.

Figure 1:
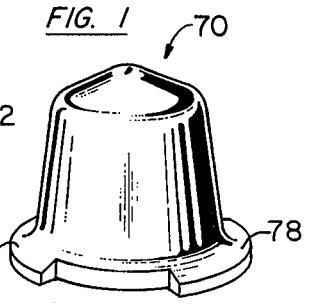
FIG. 1 is an exploded, partially cut-away perspective view of an airport light fixture, with its lamp assembly removed, constructed according to the invention.
Figure 1:
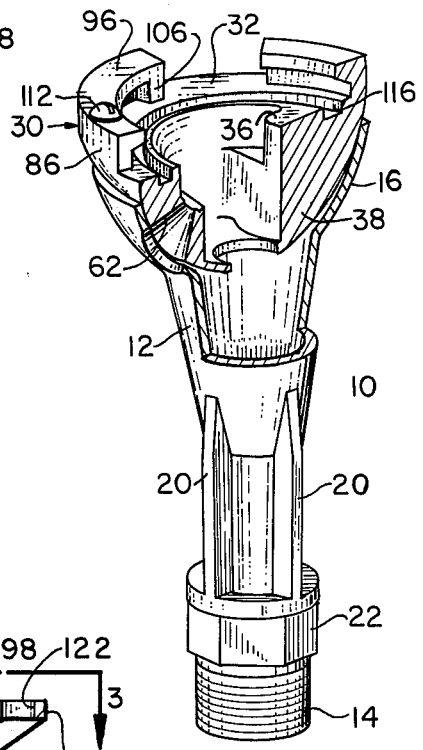
Figure 2:
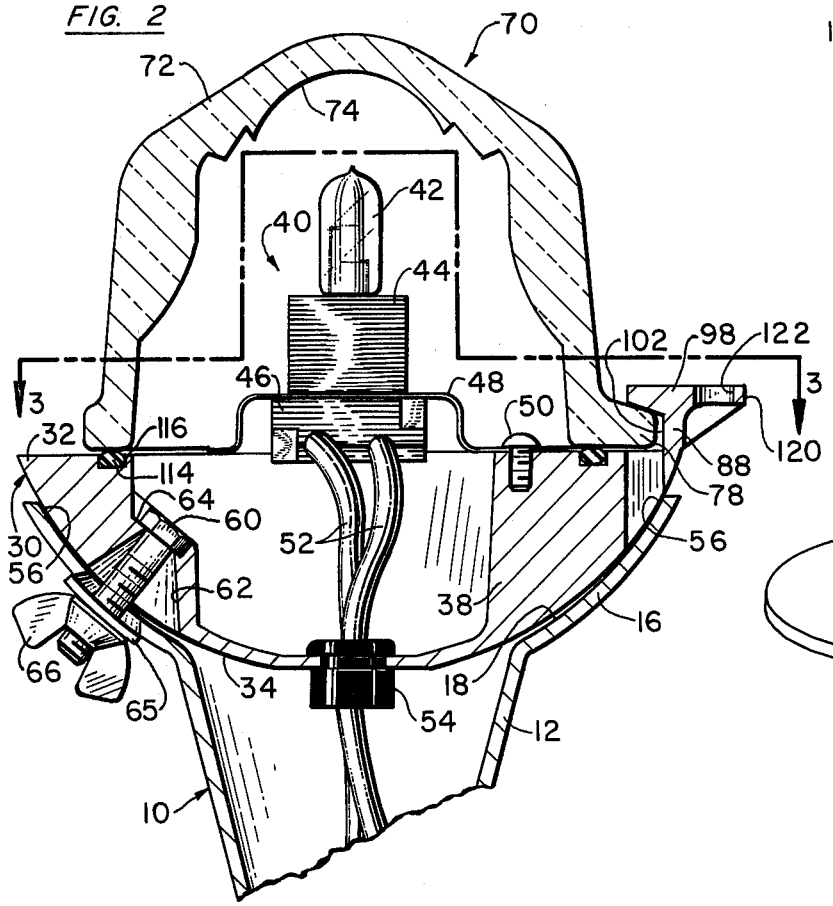
FIG. 2 is an enlarged vertical section taken along line 2—2 of FIG. 3, showing the support member, lamp base, lens, and lamp assembly of the airport light fixture.
Figure 2:
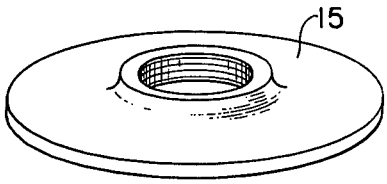

Referring to FIG. 1, an airport light fixture constructed according to the principles of the present invention includes an upright support member or pedestal, generally 10, having a hollow interior. The support member comprises a cone-shaped body 12 which tapers downwardly and includes a threaded coupling 14 at its lower end to facilitate its connection to a base plate 15 mounted in the airport runway or taxiway and provided with a suitable threaded opening. The upper end of support member 10 is curved outwardly to provide a cup-shaped upper wall or rim 16. As shown in FIG. 2, inner surface 18 of cup-shaped rim 16 defines an upwardly opening, generally concave recess at the top of support member or pedestal 10. The support member includes a plurality of external, vertical ribs 20 to strengthen the support member at its base. An integral, hexagonal nut 22 is provided to facilitate threading of support member or pedestal 10 into its base plate.

Figure 3:
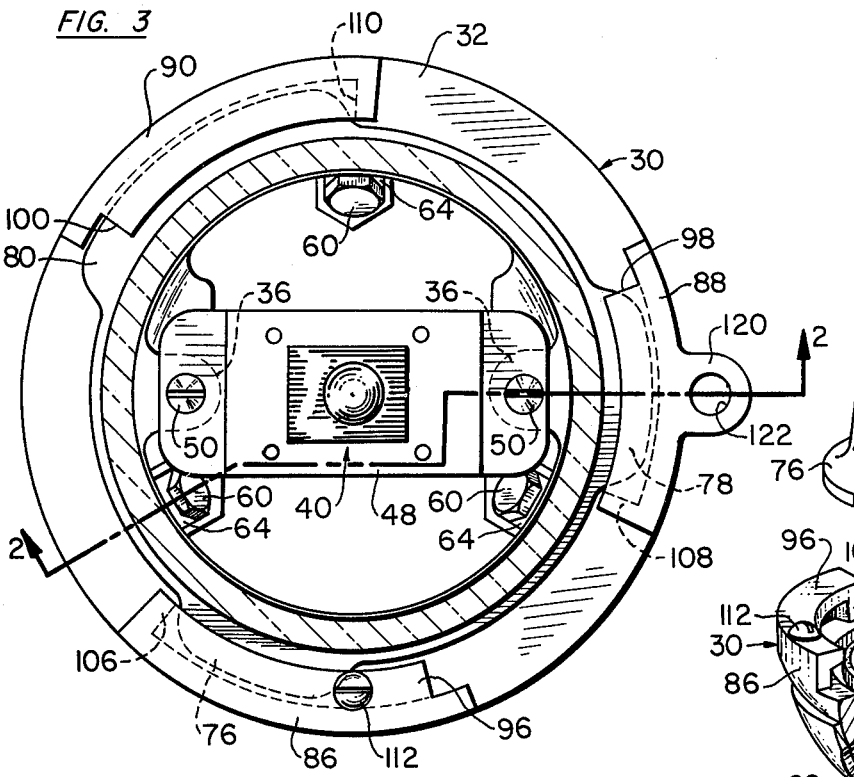
FIG. 3 is a plan view, partially in section, of the airport light fixture taken along line 3—3 of FIG. 2.

The airport light fixture includes a lamp base, generally 30, mounted at the upper end of support member or pedestal 10. Lamp base 30 has a flat, generally circular top portion 32, a generally convex bottom portion 34, and a hollow interior. As shown in FIGS. 1 and 2, the top portion of lamp base 30 includes a radially inwardly extending ledge 36 defined by an integral sidewall portion 38 of the lamp base. Referring to FIG. 3, a pair of such ledges 36 is provided at diametrically opposed positions to support a lamp assembly, generally 40.

As shown in FIG. 2, lamp assembly 40 comprises a lamp 42 having a base 44 provided with prongs (not shown) received in an electrical socket 46. The electrical socket is supported by a mounting bracket 48 secured at its opposite ends to ledges 36 by a pair of screws 50. A pair of leads 52 extends downwardly from electrical socket 46 through a grommet 54 provided in a central opening in bottom portion 34 of lamp base 30. The leads extend downward through the hollow interior of support member or pedestal 10 and a suitable connector (not shown) is provided to facilitate connection of the leads to an external power source.

In the airport light fixture of the present invention, the support member and lamp base have spherical portions of different curvature which engage at peripheral mating surfaces thereon. As demonstrated in the preferred embodiment, convex bottom portion 34 of lamp base 30 differs in curvature from the concave recess defined by the inner surface of cup-shaped upper wall or rim 16 of support member 10 to allow the lamp base to engage the support member at the periphery of the concave recess. As shown in FIGS. 1 and 2, the radius of curvature of bottom portion 34 of the lamp base is slightly larger than the radius of curvature of inner surface 18 of rim 16 of the support member. Thus, lamp base 30 engages the concave recess defined by inner surface 18 of the support member at peripheral mating surfaces 56 (FIG. 2).

The airport light fixture also includes means cooperating with the lamp base and support member for clamping the peripheral mating surfaces together. Referring to FIGS. 2 and 3, a set of bolts 60 is spaced uniformly about lamp base 30 for clamping the lamp base to support member or pedestal 10. As shown in FIG. 2, lamp base 30 includes an inwardly tapered opening 62 for each bolt extending from spherical bottom portion 34 of the lamp base to its hollow interior. Each bolt 60 extends through its opening 62 in the spherical bottom portion of lamp base 30 and into a corresponding opening provided in upper wall or rim 16 of the support member. The headed end of each bolt 60 engages an interior seat 64 on lamp base 30. A suitable washer 65 and wing nut 66 are provided to fasten bolt 60 on rim 16 of the support member or pedestal.

When bolts 60 are set into place and wing nuts 66 are tightened, convex bottom portion 34 of lamp base 30 is drawn into the concave recess defined by inner surface 18 or rim 16 of the support member or pedestal. A considerable pressure is exerted around the mating periphery between convex bottom portion 34 of the lamp base and concave upper wall 18 of the support member. As a result, the lamp base and support member are held in firm engagement at the periphery of the recess. Thus, the capability of the light fixture to withstand strong vibrations and high wind velocity is considerably enhanced.

In addition, the airport light fixture includes a lens, generally 70, cooperating with lamp base 30 to cover the lamp assembly. As shown in FIG. 2, the lens is preferably dome-shaped in configuration. It can be made of transparent, colored material to serve as a filter to emit light of desired color. Lens 70 has a smooth outer surface 72 which avoids undesired accumulation of dust and other debris. Its inner surface 74 is configured to provide the desired optical properties for the lens. For example, the lens may be designed to emit light only in a particular direction. As shown in FIG. 3, the lens includes a plurality of outwardly projecting tongues 76, 78 and 80. Tongue 80 is substantially wider than tongues 76 and 78 to facilitate the desired orientation of transparent dome 70 on lamp base 30.

Referring to FIG. 3, lamp base 30 includes a plurality of upstanding flanges 86, 88 and 90 spaced about the periphery of its circular top portion 32. The flanges are elongated and extend tangentially along the periphery of the lamp base. In addition, the flanges are adapted to provide radially inward facing channels to receive the tongues of the lens. Referring to FIG. 3, flanges 86, 88 and 90 include corresponding lips 96, 98 and 100, respectively, extending radially inward at the top of the flanges. As shown in FIG. 2, flange 88 and lip 98 form a radially inward facing channel 102 which receives outwardly projecting tongue 78 at the base of dome-shaped lens 70. Similar channels are provided by flanges 86 and 90 and corresponding lips 96 and 100 to receive tongues 76 and 80, respectively.

The preferred embodiment of the light fixture includes stop means on the lamp base for limiting movement of the tongues into the channels. As shown in FIG. 3, flange 86 includes a stop 106 extending radially inward to limit movement of tongue 76 into its channel. Similar stops 108 and 110 are provided on flanges 88 and 90 to limit movement of tongues 78 and 80 into the respective channels.

In addition, the preferred embodiment includes locking means on one of the flanges for confining the corresponding tongue within the channel to prevent disengagement of the lens from the lamp base. Referring to FIGS. 1 and 3, a manually disengageable screw fastener 112 is provided on lip 76 of flange 86. Screw 112 is received in a threaded opening (not shown) in lip 96 and extends downward into the channel below. As shown in FIG. 3, screw 112 is spaced tangentially away from stop 106 to define a space sufficiently wide to receive tongue 76. With lens 70 in its assembled position on lamp base 30, tongue 76 is confined between screw 112 and stop 106 to prevent disengagement of the lens from the lamp base.

Referring to FIG. 2, an O-ring seal 114 is received within a circular channel 116 formed in top portion 32 of lamp base 30. With lens 70 in its assembled position on the lamp base, O-ring seal 114 engages the base of the lens to provide an airtight seal to protect the lamp assembly against rain, dust and other atmospheric conditions. To achieve air-tight engagement between the base of lens 70 and O-ring seal 114, the underside of lip 98 is inclined downwardly in a radially outward direction, as shown in FIG. 2, to engage a similarly inclined top surface of tongue 78. Lips 96 and 100 and corresponding tongues 76 and 80 are also provided with similar inclined surfaces to maintain the air-tight engagement between the lens and O-ring seal.

As shown in FIGS. 2 and 3, flange 88 is provided with a flagholder comprising a ledge 120 projecting radially outward in the opposite direction from lip 98. A circular opening 122 is provided in ledge 120 to receive a flagpole. Flagholder 120 allows a flag to be mounted on the light fixture to serve as a runway or taxiway marker readily visible in daylight.

It will be understood that the airport light fixture provides a lens mounting arrangement designed for convenient assembly and removal of the lens. In the assembly of lens 70 to lamp base 30, the lens is disposed on the lamp base with its tongues 76, 78 and 80 located in the spaces between flanges 86, 88 and 90. Preferably, tongue 80, which is wider than the others, is located in the space between flanges 86 and 90 in a diametrically opposed relationship with flange 88 and flagholder 120. Flange 88 is narrower than flanges 86 and 90 and a wider space is provided between flanges 86 and 90 to receive tongue 80. Then, lens 70 is rotated in a clockwise direction, as viewed in FIG. 3, to move tongues 76, 78 and 80 into the corresponding channels defined by flanges 86, 88 and 90. Subsequently, screw 112 is threaded into lip 96 of flange 86 to project into the channel below. Tongue 76 is confined in the space between stop 106 and screw 112. Removal of the lens 70 from lamp base 30 is readily accomplished by simply unthreading screw 112, rotating the lens in a counterclockwise direction, as viewed in FIG. 3, and lifting the lens from the lamp base.

In the preferred embodiment of the airport light fixture, support member 10 and lamp base 30 are formed of metal by conventional molding or casting techniques. The tapered configuration of openings 62 in lamp base 30 facilitates removal of the lamp base from its mold. Suitable molding techniques may be used to form lens 70 of transparent glass or plastic material.

The present invention provides an airport light fixture in which the lamp base is firmly secured to the support member or pedestal to withstand the severe vibrations and high wind velocity encountered in aircraft take-offs and landings. Once the light fixture is set into place, it remains in precise adjustment and avoids the tendency of previous light fixtures to tilt and become misaligned. In addition, the airport light fixture provides an improved lens mounting arrangement which firmly secures the lens to the lamp base and yet allows the lens to be conveniently removed for repair of the light fixture.

The present invention is not limited to the specific details shown and described, and modifications may be made in the airport lamp fixture without departing from the principles of the invention.

What is claimed is:

1. In an airport light fixture having a support member provided with a spherical support surface, a lamp base provided with a mating spherical support surface engaging the spherical support surface of the support member to form a universal joint therebetween for adjusting the tilt of the lamp base, a lamp mounted on the lamp base and a lens cooperating with said lamp base to cover the lamp and direct the light emanating therefrom, and means for clamping the spherical support surfaces of said lamp base and support member together, the improvement wherein said spherical support surfaces have different curvatures to minimize the area of contact therebetween to concentrate the clamping forces on the contacting areas to prevent the relative movement of the lamp base and the support member under the severe vibrational stress encountered in use.

2. A device according to claim 1 wherein the spherical support surface of said support member is a concave recess and the spherical support surface of the lamp base is convex and has a larger radius of curvature than said concave recess so that the support member and the lamp base engage each other only at the periphery of said concave recess.

3. A device according to claim 2 wherein said clamping means comprises a plurality of bolts which are spaced uniformly about said lamp base and extend through said spherical support surface of lamp base into the support member.

4. A device according to claim 1 wherein said lamp base has a generally circular top surface having a plurality of upstanding peripherally spaced flanges providing inwardly facing channels, and said lens has a base having a plurality of peripherally spaced outwardly projecting tongues adapted to be rotatably assembled into said channels to secure the lens to the lamp base.

5. A device according to claim 4 wherein each of said tongues has an inclined top surface which slopes downwardly to wedge the lens toward the base as the lens is rotated relative thereto, and an O-ring seal mounted between the lamp base and the lens provides an air-tight seal therebetween and resiliently biases said lens away from said lamp base.

* * * * *